US011235189B2

(12) United States Patent
Chen

(10) Patent No.: US 11,235,189 B2
(45) Date of Patent: Feb. 1, 2022

(54) WEIGHT PLATE GAP ADJUSTMENT MODULE FOR WEIGHT TRAINING EQUIPMENT

(71) Applicant: HEALTHSTREAM TAIWAN INC., Taoyuan (TW)

(72) Inventor: Chun-Ting Chen, Taoyuan (TW)

(73) Assignee: HEALTHSTREAM TAIWAN INC., Taoyuan (TW)

( * ) Notice: Subject to any disclaimer, the term of this patent is extended or adjusted under 35 U.S.C. 154(b) by 0 days.

(21) Appl. No.: 17/035,045

(22) Filed: Sep. 28, 2020

(65) Prior Publication Data

US 2021/0178209 A1 Jun. 17, 2021

(30) Foreign Application Priority Data

Dec. 12, 2019 (TW) ..... 108145566

(51) Int. Cl.
*A63B 21/00* (2006.01)
*A63B 21/062* (2006.01)

(52) U.S. Cl.
CPC ..... *A63B 21/00065* (2013.01); *A63B 21/063* (2015.10); *A63B 21/0632* (2015.10); *A63B 2225/30* (2013.01)

(58) Field of Classification Search
CPC ..... A63B 21/0065; A63B 21/062; A63B 21/0622; A63B 21/0624; A63B 21/0626; A63B 21/0628; A63B 21/063; A63B 21/0632; A63B 21/0728; A63B 21/075; A63B 21/08; A63B 2225/30
See application file for complete search history.

(56) References Cited

U.S. PATENT DOCUMENTS

| | | | | |
|---|---|---|---|---|
| 4,974,837 | A * | 12/1990 | Someya | A63B 21/0628 482/98 |
| 5,342,271 | A * | 8/1994 | Long | A63B 21/063 482/98 |
| 8,632,442 | B2 * | 1/2014 | Lee | A63B 21/0628 482/97 |
| 9,186,537 | B2 * | 11/2015 | Arnold | A63B 21/062 |
| 9,242,134 | B2 * | 1/2016 | Miltner | A63B 21/0628 |
| 9,604,090 | B1 * | 3/2017 | Meyer | A63B 21/0626 |
| 9,999,796 | B2 * | 6/2018 | Leipheimer | A63B 21/00069 |
| 2006/0217245 | A1 * | 9/2006 | Golesh | A63B 21/0628 482/94 |

* cited by examiner

*Primary Examiner* — Nyca T Nguyen
*Assistant Examiner* — Zachary T Moore
(74) *Attorney, Agent, or Firm* — Muncy, Geissler, Olds & Lowe, P.C.

(57) ABSTRACT

A weight plate gap adjustment module for weight training equipment includes an elastic member located at the topmost weight plate of the weight training equipment and having a supporting portion arranged on the weight plate adjacent to the topmost weight plate, and an adjustment member set on the topmost weight plate and movable toward the elastic member to increase the elastic force of the elastic member, so that when the elastic force of the elastic member is greater than the total weight of the topmost weight plate and the traction shaft, the elastic force of the elastic member drives the elastic member to push the topmost weight plate and the traction shaft to move relative to the other weight plates, allowing the locking pin to be selectively inserted through one weight plate and the traction shaft and joined to the traction shaft.

6 Claims, 7 Drawing Sheets

WEIGHT PLATE GAP ADJUSTMENT MODULE FOR WEIGHT TRAINING EQUIPMENT

BACKGROUND OF THE INVENTION

1. Field of the Invention

The present invention relates to weight training equipment, and more particularly to a weight plate gap adjustment module for weight training equipment.

2. Description of the Related Art

A weight training equipment usually has a plurality of weight plates stacked on the top of each other. A traction shaft is placed in the center of the weight plates, and the traction shaft is driven by pulling a steel cable to pull up and lower the weight plates to produce a weight training effect. When changing the load, a locking pin is used to pass through the weight plate at a different location and the traction shaft, so that the traction shaft drives the corresponding number of weight plates through the locking pin to achieve the training effect of adjusting the load.

However, there are manufacturing tolerances in the matching aperture between the locking pin, the weight plates, and the traction shaft, resulting in a gap between the locking pin, the weight plates, and the traction shaft. As soon as the steel cable drives the traction shaft, it cannot directly move the locking pin and the weight plates. On the contrary, there will be problems of exerting force but not being able to move, and the fitness operation feels poor.

SUMMARY OF THE INVENTION

The present invention has been accomplished under the circumstances in view. It is the main object of the present invention to provide a weight plate gap adjustment module for weight training equipment, which can reduce the gap between the weight plate and the related components, thereby improving the operating feel and movement intuition.

To achieve this and other objects, a weight plate gap adjustment module is provided for use in a weight training equipment. The weight training equipment comprises a plurality of weight plates, a traction shaft inserted through the weight plates, and a locking pin selectively inserted through one weight plate and the traction shaft. The weight plates include a first weight plate placed at the top. The first weight plate is combined with the traction shaft. The weight plate gap adjustment module comprises an elastic member and an adjustment member. The elastic member is set on the first weight plate, comprising a supporting portion extending out of the first weight plate and arranged on one of the other weight plates adjacent to the first weight plate. The adjustment member is set on the first weight plate and movable toward the elastic member to increase the elastic force of the elastic member and away from the adjustment member to reduce the elastic force of the elastic member. When the adjustment member is moved toward the elastic member to the extent that the elastic force of the elastic member is greater than the total weight of the first weight plate and the traction shaft, the elastic force of the elastic member drives the elastic member to push the first weight plate and the traction shaft to move relative to the other weight plates, so that the locking pin is inserted through one of the other weight plates and the traction shaft and joined to the traction shaft.

Preferably, the elastic member is mounted inside a socket at the top side of the first weight plate.

Preferably, the adjustment member is screwed to the top side of the socket so that the bottom end of the adjustment member supports the top end of the elastic member, and the adjustment member is rotatable to move toward or away from the elastic member.

Preferably, the elastic member is a compression spring.

Preferably, the elastic member has a supporting portion located at one end thereof. The supporting portion extends out of the first weight plate and is arranged on one of the other weight plates adjacent to the first weight plate.

Preferably, the elastic force of the elastic member drives the supporting portion of the elastic member to push the first weight plate and the traction shaft to move upward by a height relative to the other weight plates. The height is equal to or slightly smaller than the gap between the traction shaft and the locking pin.

The detailed structure or feature provided by the present invention will be described in the detailed description of the subsequent implementation mode. However, those skilled in the art should be able to understand that the detailed description and the specific examples for implementing the present invention are only used to illustrate the present invention, it is not intended to limit the scope of protection of the claims of the present invention.

DETAILED DESCRIPTION OF THE INVENTION

Hereinafter, the technical content and features of the present invention will be described in detail by enumerating preferred embodiments with drawings. The weight plate gap adjustment module of weight training equipment provided by the present invention can be widely used in various fitness equipment with weight training boxes. Those skilled in the art can understand that the explanatory terms of this embodiment belong to the upper-level description that does not limit the application field. For example, the material or shape terms include but are not limited to the material or shape specified by the description content, and the position terms include but are not limited to setting, proximity, connect, or adjacency. The term "one" for the quantity of each component includes one and more than one component quantity. The directional adjectives mentioned in the content of this specification, such as "upper", "lower", "inner", "outer", "top", "bottom", etc. are only exemplary descriptions based on the normal direction of use and are not intended to limit the scope of claims.

Figure 1:
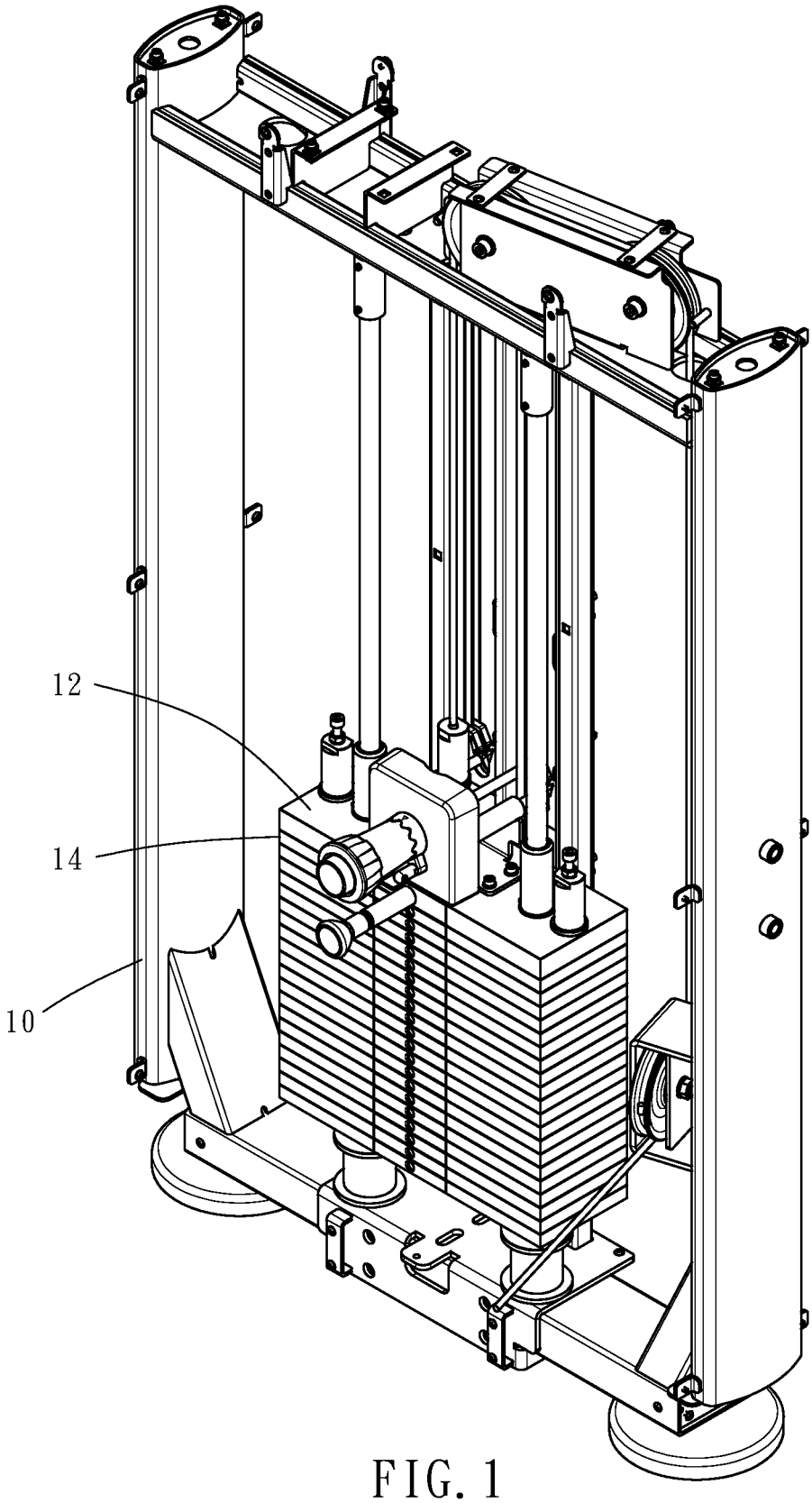
FIG. 1 is an oblique top elevational view of a weight training equipment equipped with a weight plate gap adjustment module in accordance with the present invention.
Figure 2:
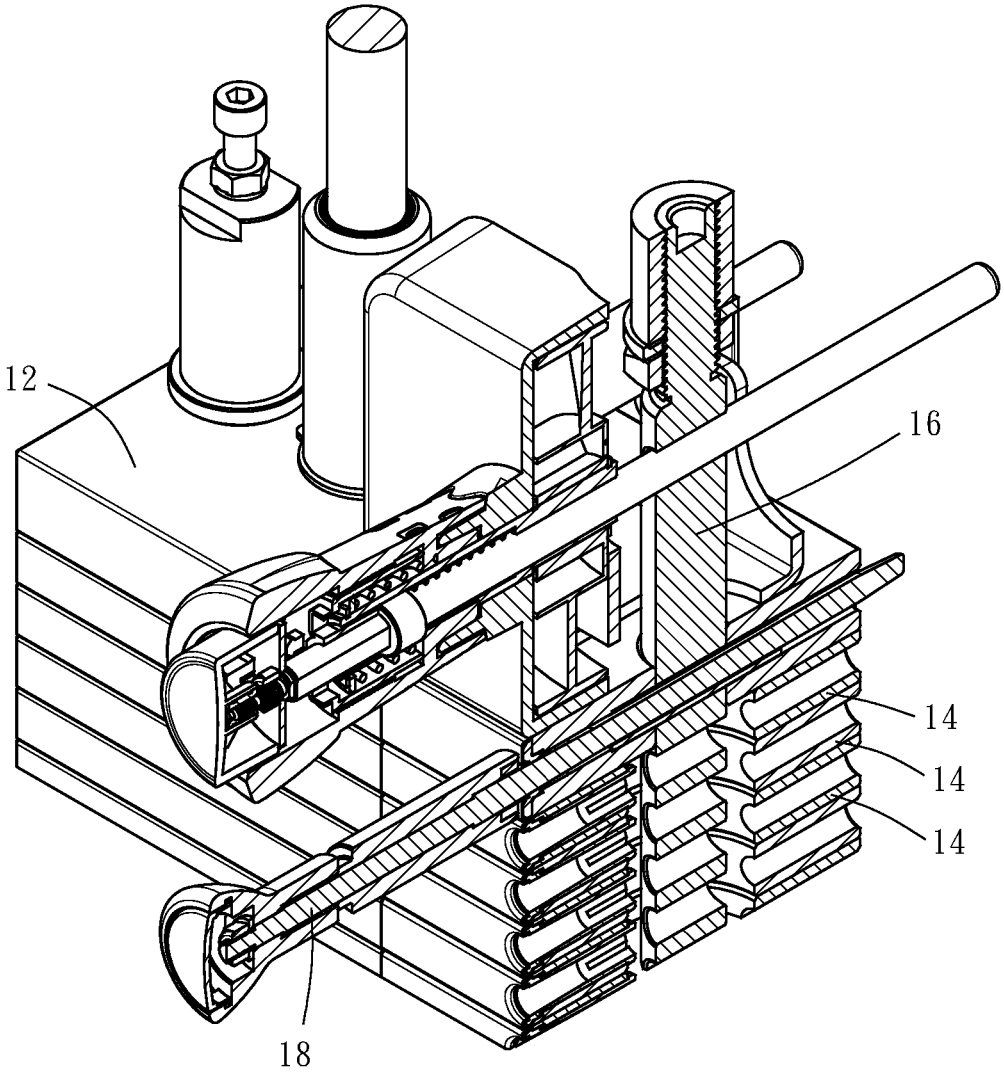
FIG. 2 is a sectional elevation of a part of the weight training equipment with the weight plate gap adjustment module in accordance with the present invention.
Figure 3:
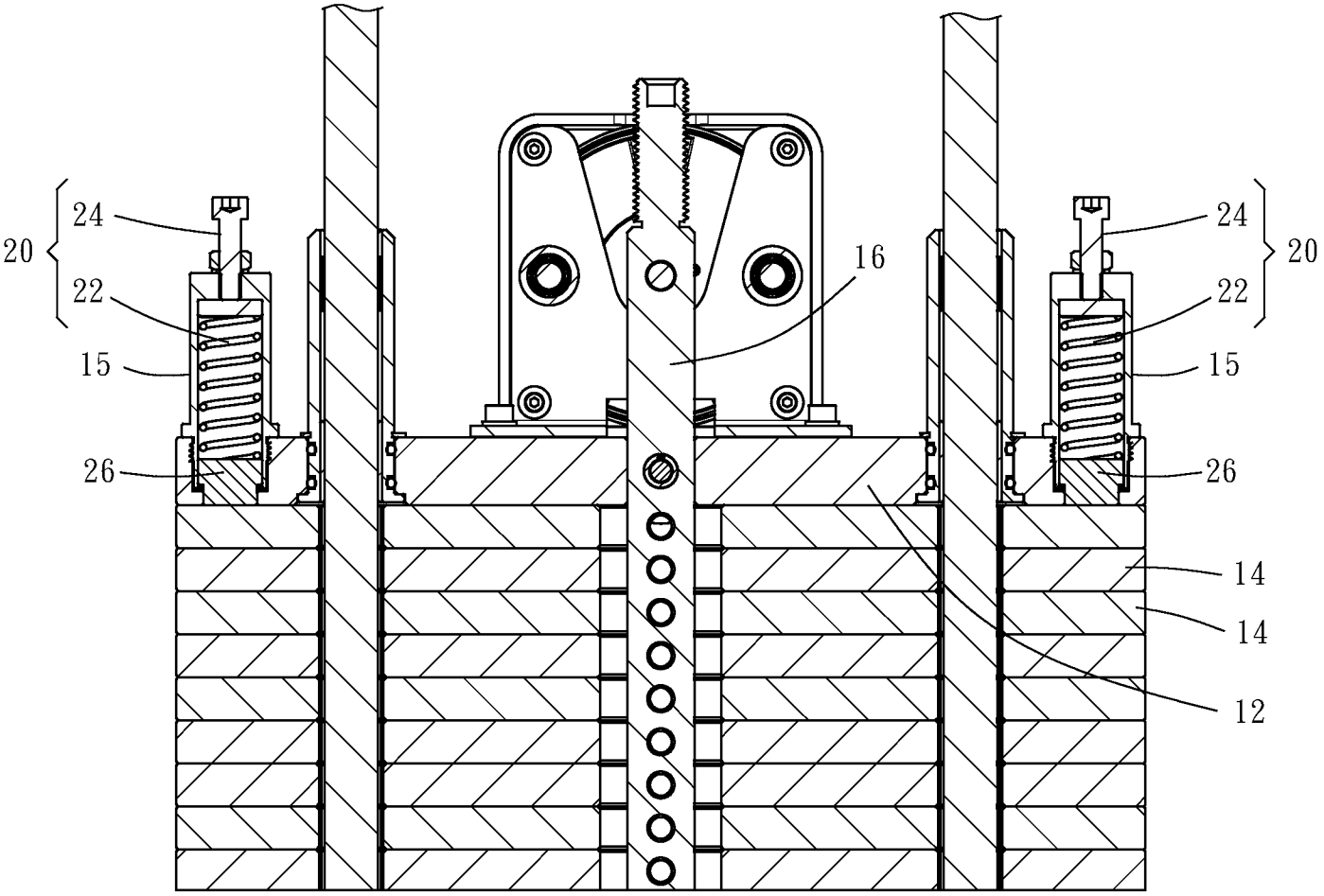
FIG. 3 is a front view of the weight plate gap adjustment module in accordance with the present invention.

Referring to FIGS. 1-3, a preferred embodiment of the present invention takes a weight training equipment with a weight training box as an example. The weight training equipment includes a weight training box 10, a first weight plate 12 and a plurality of second weight plates 14 stacked on each other in the weight training box 10, a traction shaft 16 vertically movably inserted through the center of the first weight plate 12 and the second weight plates 14, and a locking pin 18 selectively inserted through one second weight plate 14 and the traction shaft 16 to combine a different numbers of weight plates 12, 14 and the traction shaft 16 to form a different motion load. The first weight plate 12 connected to the traction shaft 16, so that the first weight plate 12 and the traction shaft 16 move up and down synchronously.

The weight plate gap adjustment module 20 comprises an elastic member 22 and an adjustment member 24. In this preferred embodiment, a weight plate gap adjustment module 20 is provided on each of both sides of the traction shaft 16 as an example. The elastic member 22 of each weight plate gap adjustment module 20 is arranged inside one respective socket 15 on the top side of the first weight plate 12. In the present preferred embodiment, the elastic member 22 is a compression spring as an example. The bottom end of the elastic member 22 is provided with a supporting portion 26, which extends from the first weight plate 12 and is arranged on the second weight plate 14 adjacent to the first weight plate 12.

The adjustment member 24 is set on the first weight plate 12 in a way that can move in the direction close to or away from the elastic member 22. In the present preferred embodiment, the adjustment member 24 has a thread screwed on the top of the socket 15, so that the bottom of the adjustment member 24 supports the top of the elastic member 22, and the top of the adjustment member 24 can be operated to rotate the adjustment member 24 toward or away from the elastic member 22. When the adjustment member 24 is rotated toward the elastic member 22, it compresses the length of the elastic member 22 and increases the elastic force of the elastic member 22. When the adjustment member 24 is rotated away from the elastic member 22, the length of elastic member 22 is released and the elastic force of elastic member 22 is reduced relatively.

Figure 4:
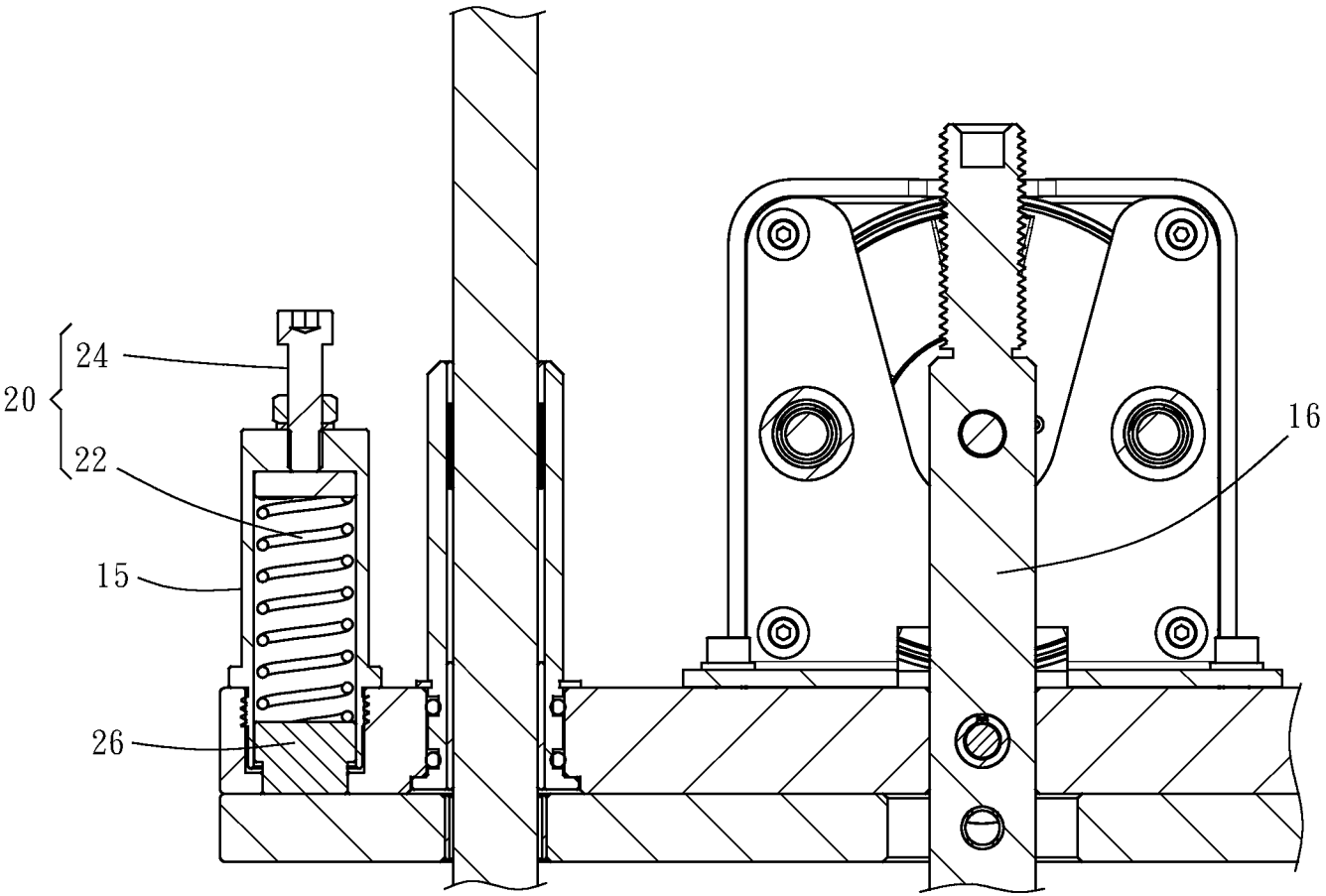
FIG. 4 is a front view of a part of the weight plate gap adjustment module in accordance with the present invention, mainly showing the operating state of the elastic member.
Figure 5:
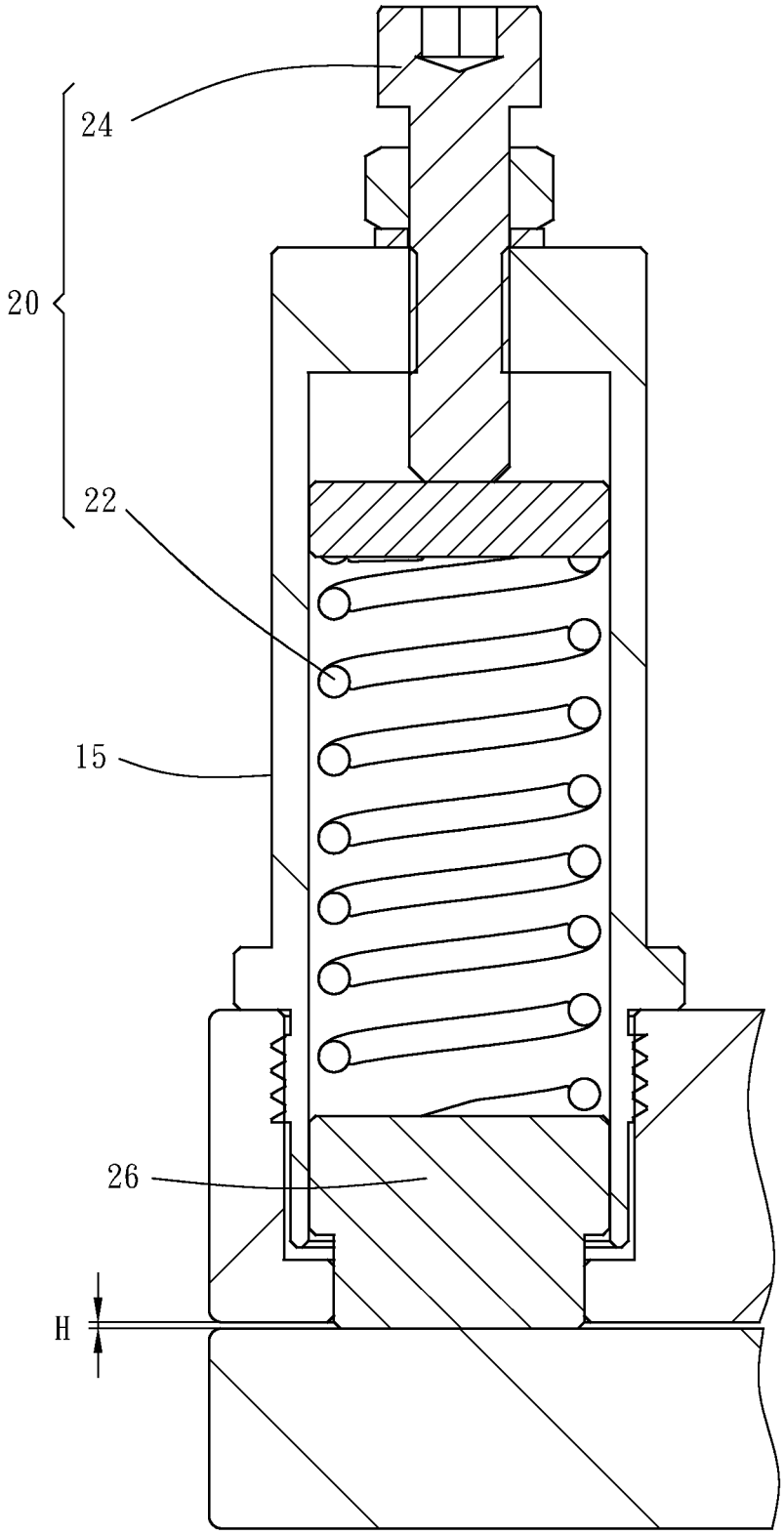
FIG. 5 is similar to FIG. 4, mainly showing the operating state of the elastic member.

With the above components, as shown in FIGS. 4 and 5, when the adjustment member 24 is rotated toward the elastic member 22 to the extent that the elastic force of the elastic member 22 is greater than the total weight of the first weight plate 12 and the traction shaft 16, the elastic force of the elastic member 22 drives the supporting portion 26 of the elastic member 22 to push the first weight plate 12 and the traction shaft 16 to move upward by a height H relative to the second weight plate 14, and the axis of the traction shaft 16 is slightly offset from the axis of the pin hole of the second weight plate 14. The height H can be equal to or slightly smaller than the gap between the traction shaft 16 and the locking pin 18.

Figure 6:
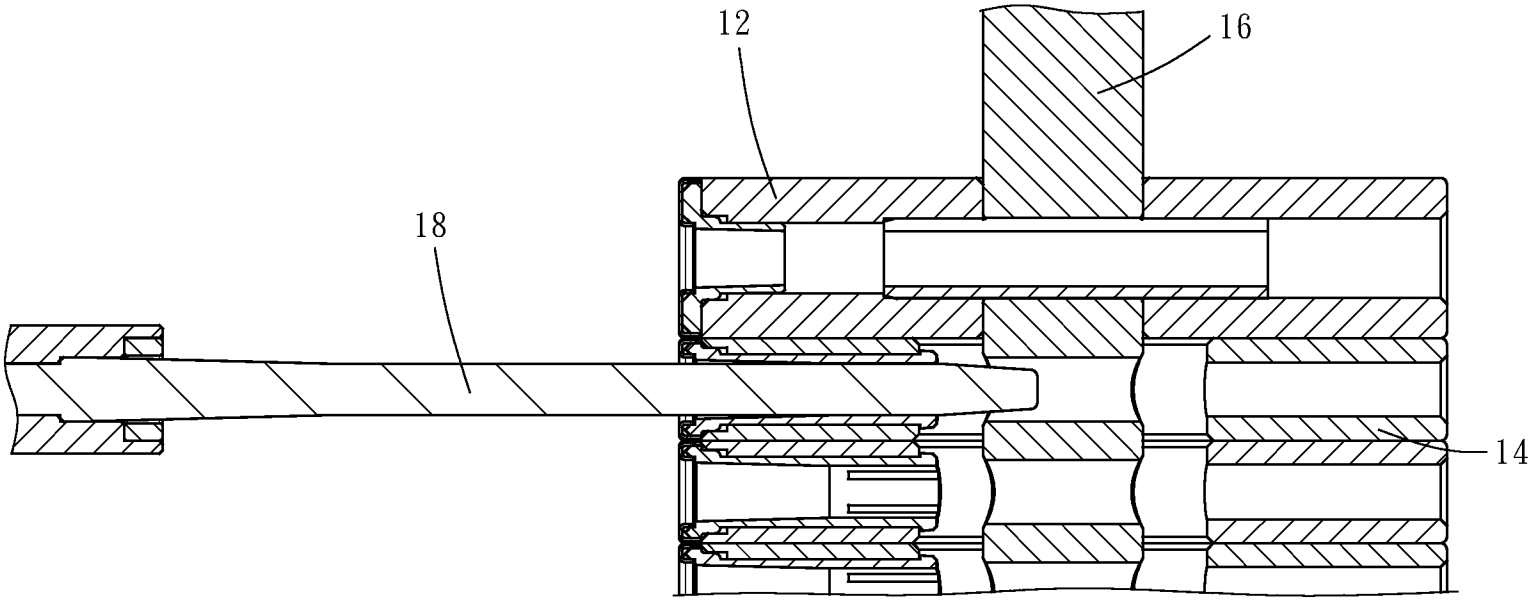
FIG. 6 is a side view of a part of the present invention, mainly showing the operating state of the locking pin.
Figure 7:
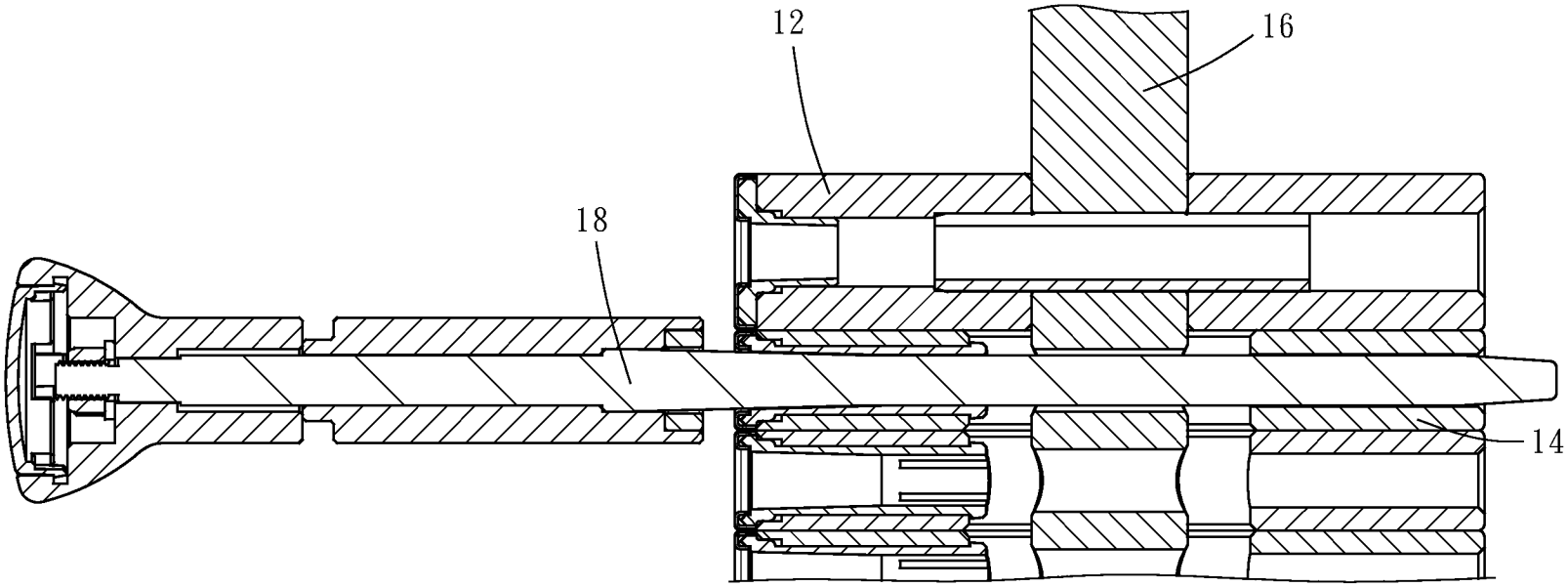
FIG. 7 is similar to FIG. 6, mainly showing the operating state of the locking pin.

As shown in FIGS. 6 and 7, when the locking pin 18 is inserted through one of the second weight plates 14 and is about to pass through the traction shaft 16, the front end of the locking pin 18 will interfere with the traction shaft 16, and then the outer peripheral surface of the locking pin 18 will be directly joined to the corresponding contact surface of the traction shaft 16.

The present invention utilizes the above-mentioned elastic member 22 to push the first weight plate 12 and the traction shaft 16, so that the traction shaft 16 and the locking pin 18 can be tightly combined to eliminate the gap between the two, so as to improve the operating feel and movement intuition.

What is claimed is:

1. A weight plate gap adjustment module for use in a weight training equipment, said weight training equipment comprising a plurality of weight plates, a traction shaft inserted through said weight plates and a locking pin selectively insertable through one said weight plate and said traction shaft, said weight plates including a first weight plate placed at a top of said weight plates, said first weight plate being combined with said traction shaft, the weight plate gap adjustment module comprising:

an elastic member set on said first weight plate, said elastic member comprising a supporting portion extending out of said first weight plate and arranged on one of the other said weight plates adjacent to said first weight plate; and an adjustment member set on said first weight plate and movable toward said elastic member to increase the elastic force of said elastic member and away from said adjustment member to reduce the elastic force of said elastic member;

wherein when said adjustment member is moved toward said elastic member to the extent that the elastic force of said elastic member is greater than the total weight of said first weight plate and said traction shaft, the elastic force of said elastic member drives said elastic member to push said first weight plate and said traction shaft to move relative to the other said weight plates, so that said locking pin is inserted through one of the other said weight plates and said traction shaft and joined to said traction shaft.

2. The weight plate gap adjustment module as claimed in claim 1, wherein said elastic member is mounted inside a socket at a top side of said first weight plate.

3. The weight plate gap adjustment module as claimed in claim 2, wherein said adjustment member is screwed to the top side of said socket so that a bottom end of said adjustment member supports a top end of said elastic member, and said adjustment member is rotatable to move toward or away from said elastic member.

4. The weight plate gap adjustment module as claimed in claim 1, wherein said elastic member is a compression spring.

5. The weight plate gap adjustment module as claimed in claim 1, wherein said elastic member has the supporting portion located at one end thereof, said supporting portion extending out of said first weight plate and arranged on one of the other said weight plates adjacent to said first weight plate.

6. The weight plate gap adjustment module as claimed in claim 1, wherein the elastic force of said elastic member drives said supporting portion of said elastic member to push said first weight plate and said traction shaft to move upward by a height relative to the other said weight plates, said height being equal to or slightly smaller than the gap between said traction shaft and said locking pin.

* * * * *